US006250239B1

(12) United States Patent
Christ et al.

(10) Patent No.: US 6,250,239 B1
(45) Date of Patent: Jun. 26, 2001

(54) EMBROIDERED FABRIC SUPPORT AND METHOD

(76) Inventors: Lisa R. Christ; Loretta Clayton, both of 7738 Barred Owl Dr., Waterloo, IL (US) 62298

( * ) Notice: Subject to any disclaimer, the term of this patent is extended or adjusted under 35 U.S.C. 154(b) by 0 days.

(21) Appl. No.: 09/699,889

(22) Filed: Oct. 30, 2000

Related U.S. Application Data

(60) Provisional application No. 60/177,934, filed on Jan. 25, 2000.

(51) Int. Cl.[7] ..... D05C 9/00; D05B 27/00

(52) U.S. Cl. ..... 112/475.18; 112/103; 112/217.1

(58) Field of Search ..... 112/260, 103, 112/475.18, 217.1; 68/240; 211/126.1; 248/128

(56) References Cited

U.S. PATENT DOCUMENTS 1,216,945 * 2/1917 Christie ..... 112/217.1
2,642,022 * 6/1953 Johnson ..... 112/260
5,251,556 * 10/1993 Ravenelle et al. ..... 112/217.1 X
5,287,640 * 2/1994 Morgan ..... 38/102.2
5,676,074 * 10/1997 Bengal ..... 112/103

* cited by examiner

*Primary Examiner*—Ismael Izaguirre
(74) *Attorney, Agent, or Firm*—Polster, Lieder, Woodruff & Lucchesi

(57) ABSTRACT

An apparatus is provided for supporting fabric placed in a frame attached to an embroidery machine to relieve the weight of the fabric and allow the embroidery frame to move under the embroidery needle, the apparatus including a pair of lightweight, slidable supports, one of each being positioned under each end of the fabric secured in the embroidery frame so as to slightly elevate and support the fabric above the plane of the embroidery frame. The supports preferably are hollow and round having a flat top wall and a bottom wall. Each top wall includes a strap to secure fabric to the support. The bottom wall is smooth and flat and slides easily on a support surface. In one preferred embodiment, the top wall of the support is removable, allowing the inner chamber of the support to be used for storage of lightweight materials. The device also can employ only one support if appropriate.

10 Claims, 3 Drawing Sheets

EMBROIDERED FABRIC SUPPORT AND METHOD

CROSS REFERENCE TO RELATED APPLICATIONS

This application claims priority to provisional patent application Ser. No. 60/177,934, filed Jan. 25, 2000.

STATEMENT REGARDING FEDERALLY SPONSORED RESEARCH OR DEVELOPMENT

Not applicable

BACKGROUND OF THE INVENTION

This application relates generally to sewing machines, and more particularly to an apparatus and method for supporting heavy or bulky fabric materials for embroidery by an embroidery attachment to a sewing machine.

Programmable embroidery machines or attachments for sewing machines are known to the art. In general, the seamstress programs a design into the device, either on a floppy disc or a card or the like and the program drives a fabric frame relative to a stationary embroidery needle in the pattern dictated by the program. The machine can be used to embroider any type of design on any type of fabric. In many cases, the devices are used to embroider decorative or information designs on clothing. For example, a company logo or name can be stitched on a shirt or jacket. The devices generally work well for their intended purposes. However, if the fabric is particularly heavy, like a denim jacket or work jacket, the weight of the fabric can bend or distort the frame and/or impede the movement of the frame, resulting in a poor embroidery job.

It would be advantageous, therefore, to have an apparatus that can support the weight of heavy fabric but still allow the fabric frame to freely move relative to the sewing needle. The apparatus must support the fabric yet allow the fabric to move with the frame.

SUMMARY OF THE INVENTION

It is among the several objects of the present invention to provide an apparatus for supporting fabric during embroidery on the fabric.

It is another object of the present invention to provide such an apparatus that supports the fabric while allowing the embroidery machine to operate normally.

It still another object of the present invention to provide such an apparatus that supports fabric during embroidery and prevents stress on the embroidery frame.

Another object of the present invention to provide such an apparatus that supports fabric during embroidery in a slidable manner which allows the embroidery frame to move unimpeded.

Yet It still another object of the present invention to provide such an apparatus that supports fabric during embroidery that is lightweight and easy to use with any embroidery machine, economical to construct and well suited for its intended purposes.

In accordance with the invention, generally stated, an apparatus is provided for supporting fabric placed in a frame attached to an embroidery machine. The apparatus relieves the weight of the fabric and allows the embroidery frame to move unimpeded under the embroidery needle. The apparatus includes a pair of lightweight, free floating or sliding supports, one of each being positioned under each end of the fabric secured in the embroidery frame so as to slightly elevate the fabric above the plane of the embroidery frame. The supports preferably are hollow and round having a top fabric support surface and a bottom, table engaging surface. Each top surface also can include a strap or lace to secure fabric to the support. The bottom, table engaging surface generally is smooth and flat and slides easily on a table top. In the preferred embodiment, the top surface of the support is removable, allowing the support to be used for storage of very light weight materials.

In use, the section of the fabric to be embroidered is secured in the embroidery frame. The fabric which extends out of the embroidery frame, if particularly expansive, can be rolled or folded and each end of the fabric placed on one of the free float supports and secured in place with the strap. As the embroidery machine drives the embroidery frame relative to the stationary embroidery needle, the ends fabric outside the embroidery frame, supported by the free floating supports, moves without binding or impinging upon the movement of the frame and without adding excess weight to the embroidery frame. It will be appreciated that for small pieces of fabric or if the fabric is secured in the frame off center, one support may suffice.

BRIEF DESCRIPTION OF THE DRAWINGS

Corresponding reference numerals indicate corresponding structure throughout the various drawings.

DETAILED DESCRIPTION OF THE INVENTION

Figure 1:
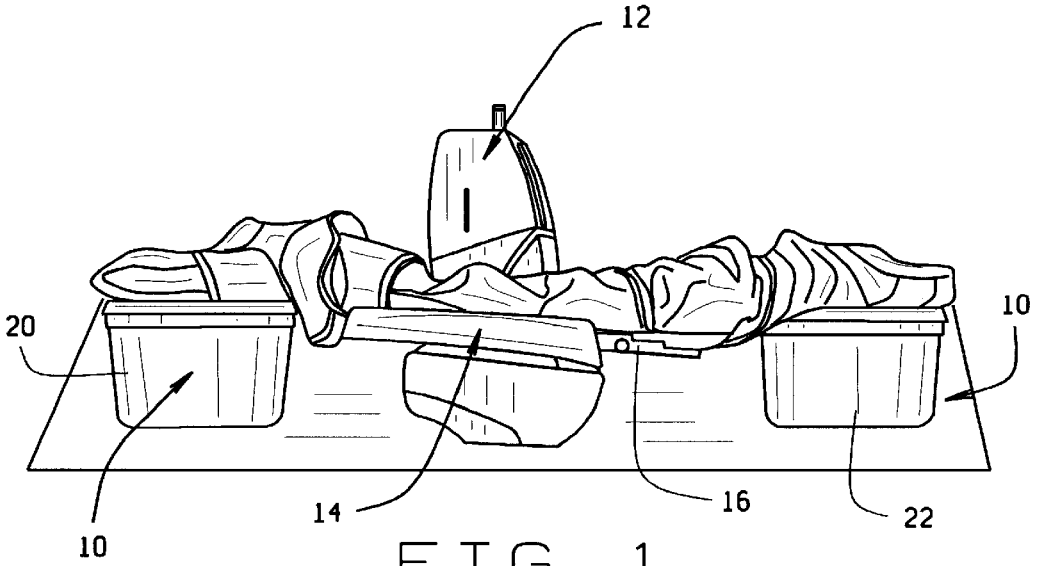
FIG. 1 is front elevational view of an embroidery machine in use with the subject fabric being supported by the apparatus for supporting fabric during embroidery of the present invention.
Figure 2:
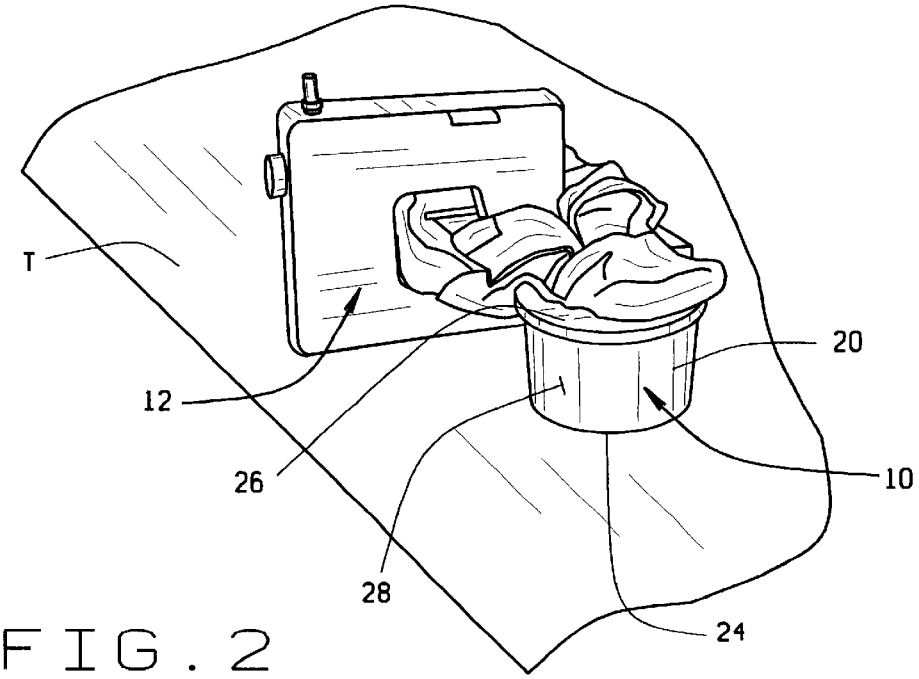
FIG. 2 is a side elevational view of an embroidery machine in use with the subject fabric being supported by the apparatus for supporting fabric during embroidery of the present invention.
Figure 3:
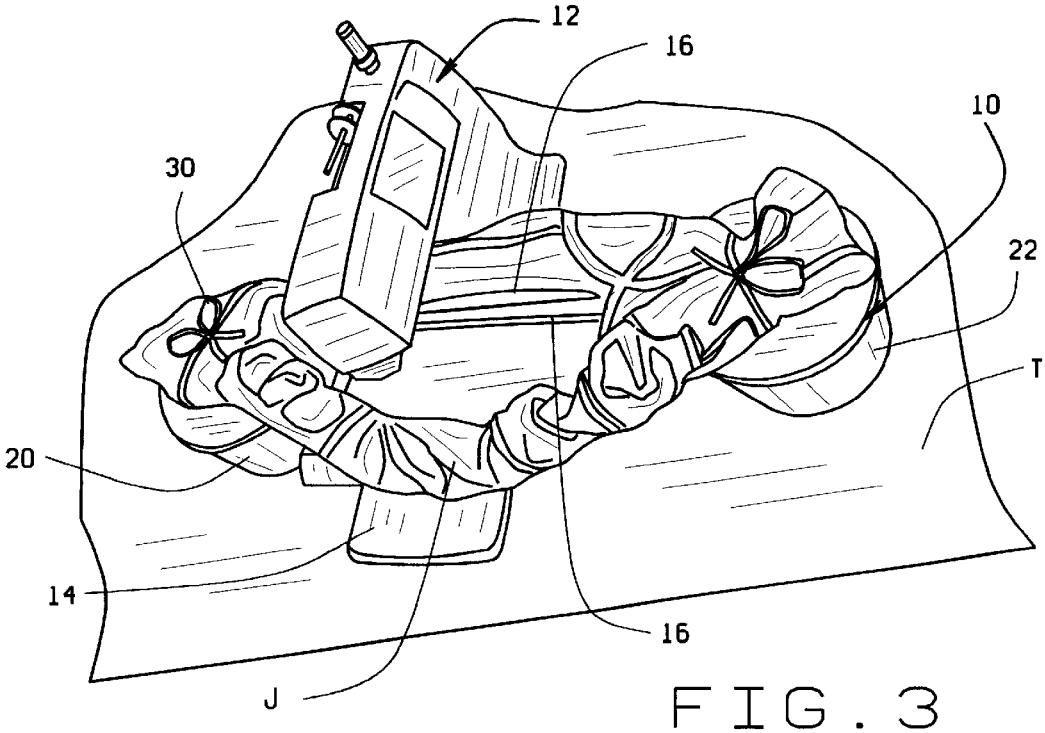
FIG. 3 is a top perspective view thereof.
Figure 4:
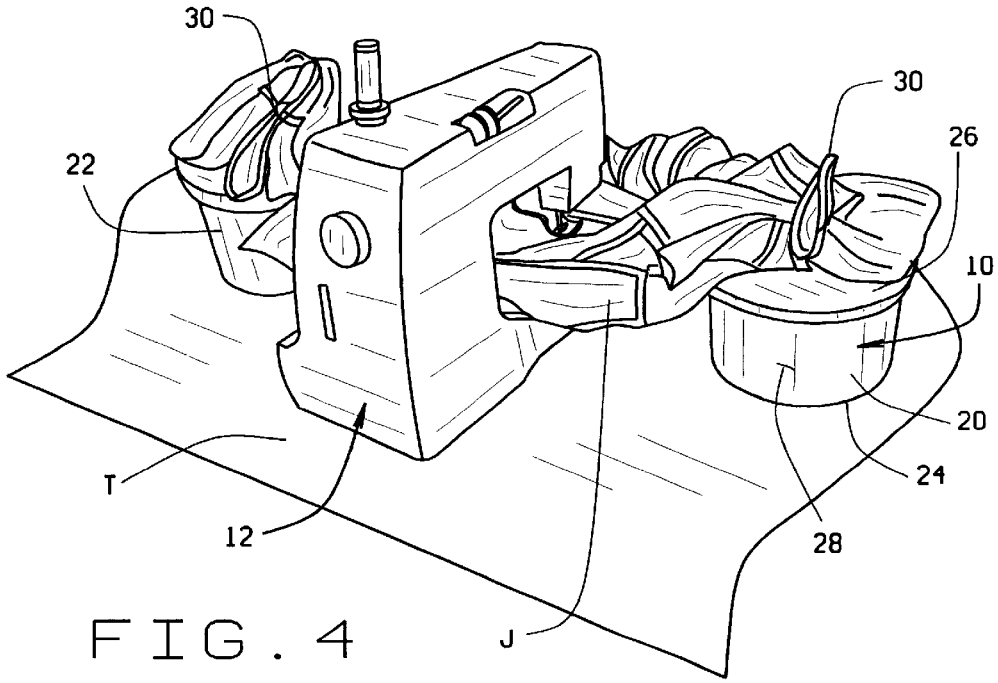
FIG. 4 is a rear perspective view thereof.
Figure 5:
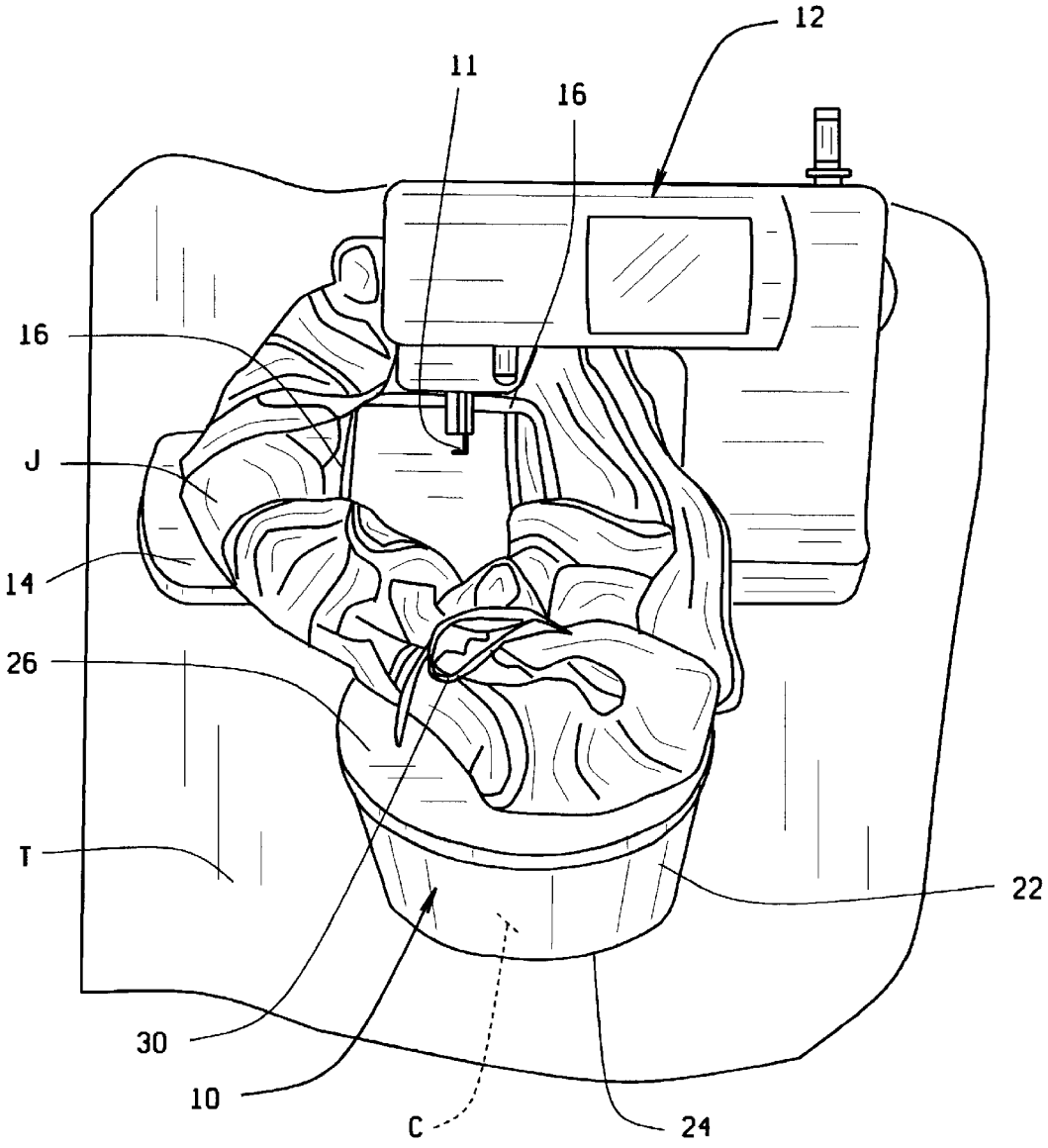
FIG. 5 is an enlarged, side perspective view thereof

The apparatus for supporting fabric during embroidery of the present invention is indicated generally in the figures by reference numeral 10. As seen in the figures, apparatus 10 is primarily designed to be used with an automatic embroidery machine, indicated generally by 12. Embroidery machine 12 is constructed similarly to a conventional sewing machine with a sewing needle 11 (FIG. 5) and an embroidery attachment or arm 14 with an operatively attached embroidery frame 16. The frame 16 is designed to secure and make taut the section of fabric to be embroidered, such as the back panel of the denim jacket J shown in the figures. Generally, speaking, the embroidery machine 12 is programmable. That is, a desired pattern to be embroidered on the fabric is provided on a card, floppy disc or the like. The program (not shown) is loaded on the machine 12. The program drives the movement of the frame 16 through the embroidery arm, moving the frame, with the fabric therein, relative to the sewing needle 11 so as to create the desired, preprogrammed design on the fabric.

It will be appreciated that the frame 16 must move freely relative to the sewing needle or else the embroidered pattern will be distorted. It also will be appreciated that heavy and/or bulky fabric, such as denim jacket J can bend or twist the frame 16 and cause an undue load on the frame, thereby preventing proper stitching of the design. Apparatus 10 overcomes that problem. Apparatus 10 is comprised of a pair of supports, 20 and 22. As show, supports 20 and 22 are substantially tub-shaped supports having identical elements with include a flat bottom wall 24 and flat top wall 26 and a peripheral wall 28. The respective walls can define an inner chamber C. It will be appreciated that one of the top or bottom walls can be removable so that lightweight materials can be stored in the inner chamber.

Bottom wall 24 should be substantially smooth and is designed to rest evenly on and slide easily across a support surface, such as tabletop T. Top wall 26 also is substantially flat and serves as a support for fabric which extends out of embroidery frame 16. It will be noted from the figures that the height of peripheral wall 28 is such that fabric supported on top wall 26 is elevated slightly above the plane of the embroidery frame. Top wall 24 also includes a securing device, such as laces 30 to tie or otherwise secure the fabric to the support element. The securing device can be laces, straps with Velcro® or any other appropriate device.

In use, the section of the fabric to be embroidered, such as a back panel of jacket J is framed in the embroidery frame 16. The excess fabric, which extends out of the embroidery frame, is folded or rolled into a convenient size. Each end of the fabric is placed upon the top wall 24 of a support element and secured in place with laces 30. The embroidery machine 12, which is preprogrammed with a chosen design, is activated. The embroidery frame 16 is moved in the appropriate pattern relative to the stationery needle 11 so as to create the chosen design. Simultaneously, the excess fabric moves along with the frame, supported by supports 20 and 22 which slide freely across the tabletop. Hence, excess weight and strain is removed from embroidery frame 16 resulting in an undistorted pattern sewn on the fabric. It will be appreciated, and is contemplated by the invention, that one slidable support can be employed to support a small fabric item or if the fabric is secured in the frame in an off center arrangement, leaving unsecured fabric on only one side of the frame 16, for example.

Various changes and modifications may be made in the apparatus of the present invention without departing from the scope of the invention. Therefore, the foregoing description and accompanying figures are intended to be illustrative only and should not be construed in a limiting sense.

What is claimed is:

1. An apparatus for supporting fabric extending out of the embroidery frame of an embroidery sewing machine positioned on a support surface comprising:

at least one slidable fabric support element for positioning under a segment of the fabric, said slidable support element including a bottom wall, a top wall and an intermediate peripheral wall, said top wall disposed to support the fabric and the bottom wall disposed to slide across the support surface in use.

2. The apparatus of claim 1 further comprising a fabric securing device on said top wall of said fabric support element to secure the segment of fabric to said top wall.

3. The apparatus of claim 1 further comprising at least a second slidable fabric support element for positioning under another segment of the fabric, said second slidable fabric support element including a bottom wall, a top wall and an intermediate peripheral wall, said top wall disposed to support the fabric and the bottom wall disposed to slide across the support surface in use.

4. The apparatus of claim 1 further comprising a second fabric securing device on said top wall of said second fabric support element to secure the segment of fabric to said top wall.

5. An apparatus for supporting fabric having a portion secured in the frame of an embroidery machine positioned on a support surface comprising:

a first slidable support element for positioning under a segment of the fabric and a second slidable support element for positioning under another segment of the fabric, each said slidable support element including a bottom wall, a top wall and an intermediate peripheral wall, each said top wall disposed to support the fabric and each said bottom wall disposed to slide freely across a support surface; and a fabric securing device on each said top wall of each support element to secure the segment of fabric to said top wall.

6. The apparatus if claim 5 wherein one of said top or bottom walls is removable.

7. The apparatus of claim 6 wherein said respective recited walls define an inner storage chamber.

8. A method of supporting fabric for embroidering with an automated embroidering device which is positioned on a support surface comprising:

securing a section of the fabric to be embroidered in a frame component of the automated embroidering device;

positioning a slidable fabric support under a section of the fabric which is not secured in the frame, said slidable fabric support including a bottom wall, a top wall and an intermediate peripheral wall, said top wall disposed to support the fabric and the bottom wall disposed to slide across the support surface in use.

9. The method of claim 8 further comprising the step of securing the fabric to the top wall of the slidable fabric support.

10. The method of claim 8 further comprising positioning a second slidable fabric support under a second section of the fabric which is not secured in the frame, said second slidable fabric support including a bottom wall, a top wall and an intermediate peripheral wall, said top wall disposed to support the fabric and the bottom wall disposed to slide across the support surface in use.

* * * * *